US006676823B1

(12) United States Patent
Bokisa

(10) Patent No.: US 6,676,823 B1
(45) Date of Patent: Jan. 13, 2004

(54) HIGH SPEED ACID COPPER PLATING

(75) Inventor: George Bokisa, North Olmsted, OH (US)

(73) Assignee: Taskem, Inc., Brooklyn Heights, OH (US)

( * ) Notice: Subject to any disclaimer, the term of this patent is extended or adjusted under 35 U.S.C. 154(b) by 0 days.

(21) Appl. No.: 10/100,708

(22) Filed: Mar. 18, 2002

(51) Int. Cl.[7] ..... C25D 3/38; C23C 18/38
(52) U.S. Cl. ..... 205/296; 106/1.26
(58) Field of Search ..... 106/1.26; 205/296

(56) References Cited

U.S. PATENT DOCUMENTS

| | | | | |
|---|---|---|---|---|
| 4,170,525 | A | 10/1979 | Kirman et al. | 204/23 |
| 4,347,108 | A | 8/1982 | Willis | 204/52 R |
| 4,384,930 | A | 5/1983 | Eckles | 204/43 S |
| 4,445,980 | A | 5/1984 | Smith | 204/15 |
| 4,469,564 | A | 9/1984 | Okinaka et al. | 204/15 |
| 4,555,315 | A | 11/1985 | Barbieri et al. | 204/52 R |
| 4,592,809 | A | 6/1986 | Fong et al. | 204/44.2 |
| 4,885,064 | A | 12/1989 | Bokisa et al. | 204/44.4 |
| 4,891,069 | A | 1/1990 | Holtzman et al. | 106/1.15 |
| 5,151,170 | A | 9/1992 | Montgomery et al. | 205/298 |
| 5,174,886 | A | 12/1992 | King et al. | 205/125 |
| 5,215,645 | A | 6/1993 | DiFranco et al. | 205/77 |
| 5,403,465 | A | 4/1995 | Apperson et al. | 205/77 |
| 5,417,841 | A | 5/1995 | Frisby | 205/296 |
| 5,431,803 | A | 7/1995 | DiFranco et al. | 205/50 |
| 5,433,840 | A * | 7/1995 | Dahms et al. | 205/296 |
| 5,976,341 | A | 11/1999 | Schumacher et al. | 205/101 |
| 6,063,172 | A | 5/2000 | Bokisa et al. | 106/1.22 |
| 6,086,744 | A | 7/2000 | Zoppi | 205/284 |
| 2002/0043467 | A1 * | 4/2002 | Morrissey et al. | 205/157 |
| 2002/0088713 | A1 * | 7/2002 | Merricks et al. | 205/80 |

OTHER PUBLICATIONS

International Search Report; PCT/US03/08083; May 30, 2003.

* cited by examiner

*Primary Examiner*—Edna Wong
(74) *Attorney, Agent, or Firm*—Amin & Turocy, LLP

(57) ABSTRACT

One aspect of the invention relates to an aqueous copper plating bath containing sulfuric acid with a specific ratio to at least one supplemental acid selected from the group consisting of fluoboric acid, alkane sulfonic acids, and alkanol sulfonic acids; a copper salt; chloride ions; and at least one sulfate bath brightener. Another aspect of the invention relates to aqueous copper plating bath containing fluoboric acid and/or an alkane sulfonic acid but no sulfuric acid, copper sulfate, chloride ions, and at least one sulfate bath brightener. Yet another aspect of the invention relates to methods of plating copper from the aforementioned copper plating baths. Still yet another aspect of the invention relates to methods of plating copper at high speed using relatively high current densities.

26 Claims, No Drawings

HIGH SPEED ACID COPPER PLATING

FIELD OF THE INVENTION

The present invention generally relates to plating copper on a substrate. In particular, the present invention relates to efficiently plating copper having desirable characteristics from acid sulfate plating baths with decreased power.

BACKGROUND OF THE INVENTION

Copper plating is used extensively in a variety of manufacturing settings. For instance, copper plating is used to prevent corrosion on various surfaces (such as on iron surfaces), copper plating is used as a binding layer for additional metal layers, copper plating is used to increase electrical or thermal conductivity, and copper plating is used to provide conducting paths in many electrical applications. Much attention for copper electroplating is directed to manufacture of electrical devices, such as circuit boards, integrated circuits, electrical contact surfaces, and the like. In fact, copper plating is indispensable in the manufacture and processing of printed circuit boards.

A particular difficulty in all copper electroplating is obtaining copper films of sufficient quality for a particular application. For example, in electrical applications, it is desirable to have ductile, smooth bright copper films with high electrical conductivity. Smooth films of uniform thickness are also highly desirable in a general sense.

The desirable characteristics of electroplated copper are impacted by the amount and source of copper in the plating baths, the amount and identity of acids in the plating baths, the amount and identity of other ions in the plating baths, current densities employed, the use of additives in the plating baths, and the like. While the use of additives can improve brightness and ductility of the copper plating, often it is desirable to simplify the composition of the plating bath. This is because additives might decompose rapidly or the use of additives might be inconvenient under certain circumstances.

Nevertheless, one concern when using copper plating baths is that specific brighteners are effective for particular plating bath chemistries. For example, the brighteners effective in a sulfuric acid-copper sulfate plating bath are typically different from the brighteners used in a boric acid-fluoboric acid-copper fluoborate plating bath. As a result, specific brighteners must be identified after a particular plating bath chemistry is selected. Such identification can be time consuming and cumbersome.

While copper plating has many attractive attributes, it has several negative characteristics. Copper plating involves enormous power consumption. Consequently, energy costs associated with copper plating operations are high. Attempts have therefore been made to perform copper plating processes at faster rates or decrease the amount of energy required. However, high speed plating requires high current densities and thus high amperage. Another problem with high current densities is that the anode tends to become inert and very high over potentials are common. This is known as polarization. Yet another problem is that it is difficult to obtain commercially acceptable copper deposits when employing high current densities, such as over 40 amperes per square foot (ASF).

In copper electroplating, copper concentration in the plating bath impacts threshold electrode current densities. Plating at increased speeds is facilitated by increasing copper solubility in the plating bath. However, it is difficult to electrolytically force copper and current from an anode into a saturated solution. Moreover, it is increasingly difficult to obtain high quality copper layers when increasing the plating speed.

In circuit board applications, it is difficult to efficiently plate copper within through holes. Higher conductivity is generally required to effectively electroplate copper in through holes. But as the conductivity is increased, the levels of copper decrease while the amount of acid increases. The lower levels of copper in solution undesirably lead to slower plating speed.

SUMMARY OF THE INVENTION

The present invention involves plating copper on substrates from a plating bath containing sulfate ions and a supplemental acid. The combination of sulfate ions and a supplemental acid in the plating bath permits the employment of increased current without anode polarization leading to increased plating speed. The combination of sulfate ions and a supplemental acid may also lead to decreased power consumption by way of enhanced solution conductivity. Increased conductivity also facilitates the effective plating within circuit board through holes. Despite the presence of a supplemental acid, such as fluoboric acid, standard sulfate plating bath brighteners may be employed in the present invention. The resultant copper layer formed in accordance with the present invention has many desirable characteristics including one or more of uniform thickness, excellent leveling, excellent ductility, lack of pinholes, bright finish, effective plating within circuit board through holes, and controllable thickness.

One aspect of the invention relates to an aqueous copper plating bath containing sulfuric acid with a specific ratio to at least one supplemental acid selected from the group consisting of fluoboric acid, alkane sulfonic acids, and alkanol sulfonic acids; a copper salt; chloride ions; and at least one sulfate bath brightener. Another aspect of the invention relates to aqueous copper plating bath containing fluoboric acid and/or methane sulfonic acid but no sulfuric acid, copper sulfate, chloride ions, and at least one sulfate bath brightener.

Yet another aspect of the invention relates to methods of plating copper from the aforementioned copper plating baths. Still yet another aspect of the invention relates to methods of plating copper at high speed using relatively high current densities.

DETAILED DESCRIPTION OF THE INVENTION

The present invention can be employed to plate copper on a substrate. The substrates that can be copper plated include metal structures and non-metal structures. Metal structures, or structures with a metal surface contain surfaces of one or more of aluminum, bismuth, cadmium, chromium, copper, gallium, germanium, gold, indium, iridium, iron, lead, magnesium, nickel, palladium, platinum, silver, tin, titanium, tungsten, zinc, and the like. Non-metal structures include plastics, circuit board prepregs (including materials such as glass, epoxy resins, polyimide resins, Kevlar®, Nylon®, Teflon®, etc.), metal oxides, and the like. With specific regard to circuit board substrates, the copper plating baths and methods of plating copper are particularly effective to plate copper within through holes present in the circuit board.

The copper plating bath is an aqueous solution. In this connection, the copper plating bath contains water.

However, the copper plating bath may optionally contain one or more co-solvents. Such co-solvents include water-miscible solvents such as alcohols, glycols, alkoxy alkanols, ketones, and various other aprotic solvents. Specific examples of co-solvents include methanol, ethanol, propanol, ethylene glycol, 2-ethoxy ethanol, acetone, dimethyl formamide, dimethyl sulfoxide, acetonitrile, and the like.

The copper plating bath contains copper. Copper is generally present in an ionic state ($Cu^{2+}$). The copper is obtained by adding a suitable copper source, such as one or more copper salts, to the plating bath. For example, copper may be obtained from a copper salt such as copper sulfate, copper polyphosphate, copper sulfamate, copper chloride, copper formate, copper fluoride, copper nitrate, copper oxide, copper tetrafluoroborate, copper trifluoromethanesulfonate, copper trifluoroacetate, or hydrates thereof, such as copper sulfate pentahydrate.

In one embodiment, the plating bath contains about 1 g/l or more and about 150 g/l or less of a copper salt (as $Cu^{2+}$). In another embodiment, the plating bath contains about 10 g/l or more and about 125 g/l or less of a copper salt. In yet another embodiment, the plating bath contains about 15 g/l or more and about 75 g/l or less of a copper salt.

The copper plating bath generally contains at least two acids. One acid is sulfuric acid and the second acid is the supplemental acid. The supplemental acids are relatively strong acids that are not oxidizing acids. Examples of supplemental acids include fluoboric acid, alkane sulfonic acids, and alkanol sulfonic acids. If one of the acids is not sulfuric acid, then the copper salt is preferably copper sulfate. If one of the acids is not sulfuric acid, and the copper salt is not copper sulfate, then a sulfate salt, such as sodium sulfate, must be added to the bath. In one embodiment, the copper plating bath does not contain boric acid or a strongly oxidizing acid.

While not wishing to be bound by any theory, it is believed that the presence of a supplemental acid increases metal solubility, thereby reducing the propensity for supersaturation. Moreover, it is believed that the presence of a supplemental acid in combination with sulfate ions increases the current at which anode polarization occurs. Increased current may be employed without the threat of anode polarization thereby increasing the plating speed, compared to sulfate containing plating baths without a supplemental acid.

Alkane sulfonic acids are represented by Formula I:

$$RSO_3H \quad (I)$$

wherein R is an alkyl group containing from about 1 to about 12 carbon atoms. In another embodiment, R is an alkyl group containing from about 1 to about 6 carbon atoms. Examples of alkane sulfonic acids include methane sulfonic acid, ethane sulfonic acid, propane sulfonic acid, 2-propane sulfonic acid, butane sulfonic acid, 2-butane sulfonic acid, pentane sulfonic acid, hexane sulfonic acid, decane sulfonic acid and dodecane sulfonic acid.

Alkanol sulfonic acids are represented by Formula II:

$$C_nH_{2n+1}-\underset{\underset{OH}{|}}{CH}(CH_2)_mSO_3H \quad (II)$$

wherein n is from about 0 to about 10, m is from about 1 to about 11 and the sum of m+n is up to about 12. As can be seen from Formula II, the hydroxy group may be a terminal or internal hydroxy group. Examples of alkanol sulfonic acids include 2-hydroxy ethyl-1-sulfonic acid, 1-hydroxy propyl-2-sulfonic acid, 2-hydroxy propyl-1-sulfonic acid, 3-hydroxy propyl-1-sulfonic acid, 2-hydroxy butyl-1-sulfonic acid, 4-hydroxy-pentyl-1-sulfonic acid, 2-hydroxy-hexyl-1-sulfonic acid, 2-hydroxy decyl-1-sulfonic acid, and 2-hydroxy dodecyl-1-sulfonic acid. The alkane sulfonic acids and alkanol sulfonic acids are available commercially and can also be prepared by a variety of methods known in the art.

In one embodiment, the copper plating bath contains about 30 g/l or more and about 280 g/l or less of sulfuric acid and about 15 g/l or more and about 325 g/l or less of one or more supplemental acids. In another embodiment, the copper plating bath contains about 60 g/l or more and about 240 g/l or less of sulfuric acid and about 50 g/l or more and about 260 g/l or less of one or more supplemental acids. In yet another embodiment, the copper plating bath contains about 80 g/l or more and about 210 g/l or less of sulfuric acid and about 90 g/l or more and about 220 g/l or less of one or more supplemental acids.

When the copper plating bath contains sulfuric acid and one or more supplemental acids, the ratio of sulfuric acid to supplemental acid (total amount of sulfuric acid to the total amount of supplemental acids) is maintained to promote the efficient plating of copper on a substrate. Typically, in most embodiments, more sulfuric acid is employed compared to supplemental acid.

In one embodiment, the ratio of sulfuric acid to supplemental acid is about 1:3 or more and about 10:1 or less (on a g/l basis). In another embodiment, the ratio of sulfuric acid to supplemental acid is about 1:2 or more and about 5:1 or less (on a g/l basis). In yet another embodiment, the ratio of sulfuric acid to supplemental acid is about 1:1 or more and about 4:1 or less (on a g/l basis).

Specifically in connection with fluoboric acid and methane sulfonic acid, in one embodiment, the ratio of sulfuric acid to fluoboric acid is about 1:2 or more and about 5:1 or less and the ratio of sulfuric acid to methane sulfonic acid is about 1:2 or more and about 4:1 or less (on a g/l basis). In another embodiment, the ratio of sulfuric acid to fluoboric acid is about 1:1 or more and about 3:1 or less and the ratio of sulfuric acid to methane sulfonic acid is about 1:1 or more and about 2:1 or less.

In one alternative embodiment, the copper plating bath does not contain sulfuric acid. In this embodiment, the copper plating bath contains one of fluoboric acid ($HBF_4$), alkane sulfonic acids, and alkanol sulfonic acids. In this embodiment, the copper salt employed to introduce copper ions into the bath is copper sulfate, and the amount of acid in the copper plating bath is that as described for the primary acid.

In these embodiments, the ratio of sulfate ions to fluoboric acid, alkane sulfonic acids, and alkanol sulfonic acids is about 1:5 or more and about 10:1 or less (on a g/l basis). In another embodiment, the ratio of sulfate ions to fluoboric acid, alkane sulfonic acids, and alkanol sulfonic acids is about 1:3 or more and about 5:1 or less.

The copper plating bath optionally contains chloride ions. In many instances, the presence of a small amount of chloride ions in the plating baths facilitates the plating process and improves the characteristics of the resultant layer of copper. Chloride ions are introduced into the plating bath by the addition of hydrochloric acid or a chloride salt, such as sodium chloride. In one embodiment, the copper plating bath contains about 0 or 1 ppm or more and about 500 ppm or less of chloride ions. In another embodiment, the copper plating bath contains about 10 ppm or more and about 200 ppm or less of chloride ions. In yet another embodiment, the copper plating bath contains about 20 ppm or more and about 100 ppm or less of chloride ions.

The copper plating bath optionally contains one or more additives. Various additives either facilitate the plating process and/or improve the characteristics of the resultant layer of copper. Additives include brighteners, carriers, leveling agents, surfactants, wetting agents, complexing agents, chelating agents, reducing agents, promoters, and the like.

In one embodiment, the copper plating bath contains about 10 ppb or more and about 5 g/l or less of one or more additives/brighteners. In another embodiment, the copper plating bath contains about 100 ppb or more and about 2 g/l or less of one or more additives/brighteners. In yet another embodiment, the copper plating bath contains about 300 ppb or more and about 1 g/l or less of one or more additives/brighteners.

Brighteners contribute to the ability of the copper plating bath to provide bright copper deposits on substrates. The brighteners effective in the plating baths of the present invention are sulfate bath brighteners, not fluoborate, cyanide, and pyrophosphate plating bath brighteners, despite the presence in the plating baths of fluoboric acid, alkane sulfonic acids, and/or alkanolsulfonic acids. Sulfate plating bath brighteners are described in U.S. Pat. Nos. 5,433,840; 5,431,803; 5,417,841; 5,403,465; 5,215,645; 5,174,886; 5,151,170; 5,145,572; 5,068,013; 5,024,736; 4,990,224; 4,954,226; 4,948,474; 4,897,165; 4,781,801; 4,673,467; 4,551,212; 4,540,473; 4,490,220; 4,430,173; 4,334,966; 4,242,181; and 2,424,887, which are hereby incorporated by reference.

General examples of sulfate bath brighteners particularly effective in the acid copper plating baths of the present invention include one or more of the reaction products of bisphenol A and ethylene oxide; polyether compounds; organic divalent sulfur compounds; organo-propyl sulfonic acids; an adduct of an alkyl amine and polyepichlorohydrin; reaction products of polyethyleneimines and an alkylating agent; organic sulfonates; high protein polymers; gelatine or animal glue; alkoxythio compounds; organic carboxylates; dithiocarbamic acids; disulfides; reaction products of a disulfide, a halohydroxy sulfonic acid, and an aliphatic aldehyde; polyalkylene glycols such as polypropylene glycols, and especially those having a molecular weight from about 1,000 to about 90,000; urea; thiourea; organic thiourea compounds; acetamides; sulfurized, sulfonated organic compounds such as sulfurized, sulfonated benzenes; reaction products of dialkylaminothioxomethyl thioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons such as sulfurized benzenes; alkylated polyalkyleneimines; phenolphthalein; epihalohydrins; sulfoalkylsulfide compounds; arylamines; polysulfides; polymeric phenazonium compounds; sulfonium compounds; and the like.

Brighteners effective in conventional boric acid-fluoboric acid-copper fluoborate plating bath, a conventional copper cyanide plating bath, or a conventional pyrophosphate-orthophosphate plating bath are not necessarily effective in the copper plating baths of the present invention. Fluoborate, cyanide, and pyrophosphate brighteners generaly include mercaptothiadiazoles, iminodiacetic acid, acetylenic alcohols, sulfamic acids, glucoheptonic acid, and phosphonates. In one embodiment, the plating baths of the present invention do not contain fluoborate, cyanide, and pyrophosphate brighteners, such as those mentioned above.

Leveling agents promote the formation of a flat, planar surface of the plated copper layer, even if the surface on which the copper layer is formed is not smooth. Examples of leveling agents include the condensation products of thiourea and aliphatic aldehydes; thiazolidinethiones; imidazolidinethiones; quaternized polyamines; and the like.

Wetting agents promote leveling and brightening, as well as promoting bath stability. Examples of wetting agent include polyoxyalkylated naphthols; ethylene oxide/polyglycol compounds; sulfonated wetting agents; carbowax type wetting agents; and the like.

Surfactants contribute to the overall stability of the bath and improve various properties in the resultant copper layer. General examples of surfactants include one or more of a nonionic surfactant, cationic surfactant, anionic surfactant, and amphoteric surfactant. Specific examples of surfactants include nonionic polyoxyethylene surfactants; alkoxylated amine surfactants; ethylene oxide-fatty acid condensation products; polyalkoxylated glycols and phenols; betaines and sulfobetaines; amine ethoxylate surfactants; quatemary ammonium salts; pyridinium salts; imidazolinium salts; sulfated alkyl alcohols; sulfated lower ethoxylated alkyl alcohols; and the like.

Chelating agents facilitate the displacement of metal in the plating bath. Examples of chelating agents include polyamines; aminocarboxylic acids; hydroxycarboxylic acids; and the like.

Specific examples of additives include those under the trade designations/codes Ralufon®, such as Ralufon® NO 14 (an alkoxylated beta-naphthol), SPS (bis-(sodium sulfopropyl)-disulfide), MPS (3-mercapto-1-propanesulfonic acid sodium salt), ZPS (3-(benzothiazolyl-2-mercapto)-propylsulfonic acid sodium salt), DPS (N,N-dimethyl-dithiocarbamyl propylsulfonic acid sodium salt), OPX (O-ethyldithiocarbonato-S-(3-sulfopropyl)-ester potassium salt), UPS (3-S-isothiuronium propyl sulfonate), Leveller 135 CU (sulfopropylated polyethylene imine), and EXP 2887 (cross-linked polyamine) available from Raschig Corporation.

The pH of the plating bath is maintained to promote the efficient plating of copper on a substrate. In one embodiment, the pH is about 3 or less. In another embodiment, the pH is about 2 or less. In yet another embodiment, the pH is about 1 or less. In the embodiment where only fluoboric acid or an alkane sulfonic acid is employed, the pH is about 2 or less. The pH of the plating bath may be adjusted using an acid or a basic compound. For example, sodium hydroxide and/or sulfuric acid may be used to adjust the pH of the bath.

The temperature of the plating bath is maintained to promote the efficient plating of copper on a substrate. In one embodiment, the temperature of the copper plating bath, during plating, is about 15° C. or more and about 80° C. or less. In another embodiment, the temperature of the copper plating bath is about 25° C. or more and about 70° C. or less. In yet another embodiment, the temperature of the copper plating bath is about 30° C. or more and about 60° C. or less.

A current density is imposed from an energy source through the electrodes causing copper ions from the plating bath to migrate towards and attach to the substrate forming a layer of copper thereon. Due, in part, to the components present in the copper plating bath, a wide range of current densities may be employed. In one embodiment, current densities of about 1 ASF or more and about 1,000 ASF or less are employed. In another embodiment, current densities of about 10 ASF or more and about 500 ASF or less are employed. In yet another embodiment, current densities of about 20 ASF or more and about 400 ASF or less are employed.

The plating methods of the present invention are particularly effective at relatively high current densities. High speed plating, in some instances, is facilitated by high current densities. In this connection, relatively high current densities are those of about 50 ASF or more, about 100 ASF or more and even about 112 ASF or more.

Any anode, cathode, power source, bath container, agitator, etc. suitable for plating metal such as copper on a substrate may be employed in the present invention. Any suitable source of power is connected to the electrodes, such as direct current or alternating current. Once the electrodes and the substrate are in contact or immersed in the copper plating bath of the present invention, a suitable current is applied. Once a copper layer of desired thickness is deposited on the substrate, the plated substrate is removed from the plating bath and optionally rinsed with water. The plated substrate may then be subjected to further processing.

While not wishing to be bound by any theory, it is believed that the presence of a supplemental acid, in combination with sulfate ions, improves the conductivity of the plating bath, which permits lower voltages to achieve the same amperage. The lower voltages means that power consumption is reduced (compared to a sulfate containing copper plating bath without the supplemental acid). Improved conductivity also minimizes heating the plating bath due to electrical resistance. High speed plating and plating of through holes in printed circuit boards is thereby facilitated by the sulfate based copper plating baths of the present invention.

In one embodiment, compared to a sulfate containing copper plating bath without the supplemental acid, the plating baths of the present invention require at least about 15% less power to plate a copper layer of similar thickness (under generally the same conditions). In another embodiment, compared to a sulfate containing copper plating bath without the supplemental acid, the plating baths of the present invention require at least about 30% less power to plate a copper layer of similar thickness (under generally the same conditions).

The length of time that the substrate is in contact with the plating bath under a specified current density depends upon the desired thickness of the resultant copper layer and the concentrations of the bath components. In one embodiment, the substrate is in contact with the plating bath under a specified current density for a time of about 5 seconds or longer and about 360 minutes or shorter. In another embodiment, the substrate is in contact with the plating bath under a specified current density for a time of about 10 seconds or longer and about 180 minutes or shorter. In yet another embodiment, the substrate is in contact with the plating bath under a specified current density for a time of about 30 seconds or longer and about 30 minutes or shorter.

In one embodiment, the thickness of the resultant copper layer plated in accordance with the present invention is about 0.1 micron or more and about 1,000 microns or less. In another embodiment, the thickness of the resultant copper layer plated in accordance with the present invention is about 1 micron or more and about 100 microns or less.

The resultant copper layer plated in accordance with the present invention has many desirable characteristics including one or more of uniform thickness, excellent leveling, excellent ductility, lack of pinholes, bright finish, effective plating within circuit board through holes, and controllable thickness.

Uniform thickness means uniform in two senses. First, a uniformly thick copper layer results when plating a flat or uneven surface substrate and the copper layer has substantially the same thickness in any location on the surface of the substrate. This uniformly thick copper layer is planar and flat when the surface of the substrate is planar and flat while the uniformly thick copper layer may have an uneven surface mimicking the uneven contours of the underlying substrate surface. Second, a uniformly thick copper layer results when plating an uneven surface substrate so that the resultant copper layer appears planar and flat and the copper layer has substantially the same thickness within locally flat regions on the surface of the substrate. This second sense also refers to excellent leveling.

The following examples illustrate the present invention. Unless otherwise indicated in the following examples and elsewhere in the specification and claims, all parts and percentages are by weight, all temperatures are in degrees Centigrade, and pressure is at or near atmospheric pressure.

COMPARATIVE EXAMPLE 1

A plating bath is prepared by combining water, 210 g/l $CuSO_4.5H_2O$, 75 g/l $H_2SO_4$, 50 ppm chloride ion from HCl, and 1.6 ml/l of conventional sulfate bath additives.

A clean polished brass panel is plated with copper in the plating bath under air agitation. The initial temperature of the plating bath is 35° C. Plating is conducted at 10 amps. 9.8 V is initially required to achieve 10 amps. The anode polarized in about 70 seconds, forcing a voltage increase to over 18.75 V (maximum rectifier voltage) after 130 seconds to maintain 10 amps. Plating bath temperature increased to 50° C. during plating.

COMPARATIVE EXAMPLE 2

The plating bath of Comparative Example 1 is prepared, and an additional 170 g/l $H_2SO_4$ is added. A clean polished brass panel is plated with copper in the plating bath under air agitation at a temperature of 45° C. Plating is conducted at 10 amps. 3.7 V is initially required to achieve 10 amps. The anode polarized immediately forcing a voltage increase to over 18.75 V after 120 seconds to maintain 10 amps.

EXAMPLE 1

The plating bath of Comparative Example 1 is prepared, and 67 g/l of fluorboric acid is added. A clean polished brass panel is plated with copper in the plating bath under air agitation at a temperature of 45° C. Plating is conducted at 10 amps. 6.5 V is initially required to achieve 10 amps. Voltage and current are constant for more than 180 seconds.

EXAMPLE 2

The plating bath of Comparative Example 1 is prepared, and 93 g/l of methanesulfonic acid is added. A clean polished brass panel is plated with copper in the plating bath under air agitation at a temperature of 45° C. Plating is conducted at 10 amps. 6.1 V is initially required to achieve 10 amps. Voltage and current are constant for more than 180 seconds.

TABLE 1

| Example | Added acid conc | init. V | Anode Polarizn | Power Savings |
|---|---|---|---|---|
| CE 1 | none | 9.8 | Y, 70 seconds | standard |
| CE 2 | $H_2SO_4$, 170 g/l | 3.7 | Y, immediate | none |

TABLE 1-continued

| Example | Added acid conc | init. V | Anode Polarizn | Power Savings |
|---|---|---|---|---|
| Ex 1 | $HBF_4$, 67 g/l | 6.5 | N | 33.7% |
| Ex 2 | MSA, 93 g/l | 6.1 | N | 37.8% |

COMPARATIVE EXAMPLE 3

A plating bath is prepared by combining water, 375 g/l $CuSO_4.5H_20$, 75 g/l $H_2SO_4$, 50 ppm chloride ion from HCl, and 1.6 ml/l of conventional sulfate bath additives. The bath is supersaturated at room temperature (21° C.). The temperature of the bath is increased to 45° C. in order to prevent copper sulfate from crystallizing and precipitating.

EXAMPLE 3

The plating bath of Comparative Example 3 is prepared, and 90 g/l of fluorboric acid is added. The bath is free of copper sulfate crystals at room temperature (21° C.).

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An aqueous copper plating bath, comprising:

about 80 g/l or more and about 280 g/l or less of at least one of fluoboric acid, an alkane sulfonic acid, and an alkanol sulfonic acid with the proviso that sulfuric acid is not added to the aqueous copper plating bath;

about 15 g/l or more and about 150 g/l or less of copper sulfate;

about 1 ppm or more and about 500 ppm or less of chloride ions; and about 10 ppb or more and about 5 g/l or less of at least one sulfate bath brightener.

2. The aqueous copper plating bath of claim 1, wherein the sulfate bath brightener comprises at least one selected from the group consisting of reaction products of bisphenol A and ethylene oxide; polyether compounds; organic divalent sulfur compounds; organo-propyl sulfonic acids; an adduct of an alkyl amine and polyepichlorohydrin; reaction products of polyethyleneimines and an alkylating agent; organic sulfonates; high protein polymers; animal glue; alkoxythio compounds; organic carboxylates; dithiocarbamic acids; disulfides; reaction products of a disulfide, a halohydroxy sulfonic acid, and an aliphatic aldehyde; polyalkylene glycols; urea; thiourea; organic thiourea compounds; acetamides; sulfurized, sulfonated organic compounds; reaction products of dialkylaminothioxomethylthioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons; alkylated polyalkyleneimines; phenolphthalein; epihalohydrins; sulfoalkylsulfide compounds; and arylamines.

3. A method of plating copper on a substrate, comprising:

contacting the substrate with a plating bath comprising a copper salt, sulfuric acid, and at least one supplemental acid selected from the group consisting of fluoboric acid, alkane sulfonic acids, and alkanol sulfonic acids, a ratio of sulfuric acid to supplemental acid is about 1:3 or more and about 10:1 or less;

applying a current of about 50 ASF or more and about 1,000 ASF or less to the plating bath whereby copper deposits on the substrate; and recovering the substrate having a layer of copper thereon.

4. The method of claim 3, wherein the plating bath has a temperature of about 15° C. or more and about 80° C. or less.

5. The method of claim 3, wherein the current is applied for a time of about 5 seconds or longer and about 360 minutes or shorter.

6. The method of claim 3, wherein the plating bath comprises about 30 g/l or more and about 280 g/l or less of the sulfuric acid, about 15 g/l or more and about 325 g/l or less of the at least one supplemental acid, and about 1 g/l or more and about 150 g/l or less of the copper salt.

7. The method of claim 3, wherein the supplemental acid comprises at least one of fluoboric acid and methane sulfonic acid.

8. The method of claim 7, wherein the bath comprises about 50 g/l or more and about 260 g/l or less of fluoboric acid.

9. The method of claim 3, wherein the plating bath further comprises at least one sulfate bath brightener selected from the group consisting of reaction products of bisphenol A and ethylene oxide; polyether compounds; organic divalent sulfur compounds; organo-propyl sulfonic acids; an adduct of an alkyl amine and polyepichlorohydrin; reaction products of polyethyleneimines and an alkylating agent; organic sulfonates; high protein polymers; animal glue; alkoxythio compounds; organic carboxylates; dithiocarbamic acids; disulfides; reaction products of a disulfide, a halohydroxy sulfonic acid, and an aliphatic aldehyde; polyalkylene glycols; urea; thiourea; organic thiourea compounds; acetamides; sulfurized, sulfonated organic compounds; reaction products of dialkylaminothioxomethylthioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons; alkylated polyalkyleneimines; phenolphthalein; epihalohydrins; sulfoalkylsulfide compounds; and arylamines.

10. The method of claim 3, wherein the layer of copper has a thickness of about 0.1 micron or more and about 1,000 microns or less.

11. The method of claim 3, wherein the current applied to the plating bath is about 100 ASF or more and about 1,000 ASF or less.

12. A method of plating copper on a substrate, comprising:

contacting the substrate with a plating bath comprising a copper salt, sulfuric acid, and at least one of fluoboric acid and an alkane sulfonic acid;

applying a current of at least about 112 ASF to the plating bath whereby copper deposits on the substrate; and recovering the substrate having a layer of copper thereon.

13. The method of claim 12, wherein the plating bath has a temperature of about 25° C. or more and about 70° C. or less and the current is applied for a time of about 10 seconds or longer and about 180 minutes or shorter.

14. The method of claim 12, wherein the plating bath further comprises chloride ions.

15. The method of claim 12, wherein the plating bath further comprises at least one sulfate bath brightener.

16. The method of claim 15, wherein the sulfate bath brightener comprises at least one selected from the group consisting of reaction products of bisphenol A and ethylene oxide; polyether compounds; organic divalent sulfur compounds; organo-propyl sulfonic acids; an adduct of an alkyl amine and polyepichlorohydrin; reaction products of polyethyleneimines and an alkylating agent; organic sulfonates; high protein polymers; animal glue; alkoxythio compounds; organic carboxylates; dithiocarbamic acids; disulfides; reaction products of a disulfide, a halohydroxy sulfonic acid, and an aliphatic aldehyde; polyalkylene glycols; urea; thiourea; organic thiourea compounds; acetamides; sulfurized, sulfonated organic compounds; reaction products of dialkylaminothioxomethylthioalkane sulfonic acids; hydroquinones; ethoxylated alkylphenols; polyethylene oxides; disubstituted ethane sulfonic compounds; sodium lauryl sulfate; tosyl and mesyl sulfonic acids; alkoxylated lactam amides; glycerin; alkylarylenes; sulfurized hydrocarbons; alkylated polyalkyleneimines; phenolphthalein; epihalohydrins; sulfoalkylsulfide compounds; and arylamines.

17. The method of claim 12, wherein the plating bath comprises about 30 g/l or more and about 280 g/l or less of the sulfuric acid, about 15 g/l or more and about 325 g/l or less of the at least one of fluoboric acid and the alkane sulfonic acid, and about 1 g/l or more and about 150 g/l or less of the copper salt.

18. The method of claim 12, wherein the substrate comprises one selected from the group consisting of metal structures, plastics, and circuit board prepregs.

19. The method of claim 12, wherein the layer of copper has a smooth and planar surface and a thickness of about 1 micron or more and about 100 microns or less.

20. A method of plating copper on a substrate, comprising:

contacting the substrate with a plating bath comprising about 30 g/l or more and about 280 g/l or less of sulfuric acid, about 15 g/l or more and about 150 g/l or less of copper sulfate, about 15 g/l or more and about 325 g/l or less of fluoboric acid, about 1 ppm or more and about 500 ppm or less of chloride ions, and about 10 ppb or more and about 5 g/l or less of at least one sulfate bath brightener, a ratio of sulfuric acid to fluoboric acid is about 1:2 or more and about 5:1 or less;

applying a current of about 50 ASF or more and about 1,000 ASF or less to the plating bath whereby copper deposits on the substrate; and recovering the substrate having a layer of copper thereon.

21. The method of claim 20, wherein the ratio of sulfuric acid to fluoboric acid is about 1:1 or more and about 4:1 or less.

22. The method of claim 20, wherein the plating bath comprises 80 g/l or more and about 210 g/l or less of the sulfuric acid, about 90 g/l or more and about 220 g/l or less of the fluoboric acid, about 15 g/l or more and about 75 g/l or less of the copper sulfate, about 20 ppm or more and about 100 ppm or less of the chloride ions, and about 300 ppb or more and about 1 g/l or less of the at least one sulfate bath brightener.

23. The method of claim 20, with the proviso that the aqueous copper plating bath does not comprise fluoborate based copper plating bath brighteners, cyanide based copper plating bath brighteners, and pyrophosphate based copper plating bath brighteners.

24. The method of claim 20, wherein the current applied to the plating bath is about 100 ASF or more and about 1,000 ASF or less and the plating bath comprises about 50 g/l or more and about 325 g/l or less of the fluoboric acid.

25. A method of plating copper on a substrate, comprising:

contacting the substrate with a plating bath comprising about 30 g/l or more and about 280 g/l or less of sulfuric acid, about 15 g/l or more and about 150 g/l or less of copper sulfate, about 15 g/l or more and about 325 g/l or less of methane sulfonic acid, about 1 ppm or more and about 500 ppm or less of chloride ions, and about 10 ppb or more and about 5 g/l or less of at least one sulfate bath brightener, a ratio of sulfuric acid to methane sulfonic acid is about 1:2 or more and about 4:1 or less;

applying a current of about 50 ASF or more and about 1,000 ASF or less to the plating bath whereby copper deposits on the substrate; and recovering the substrate having a layer of copper thereon.

26. The method of claim 25, wherein the current applied to the plating bath is about 100 ASF or more and about 1,000 ASF or less and the plating bath comprises about 50 g/l or more and about 325 g/l or less of the methane sulfonic acid.

* * * * *